United States Patent [19]

Gibrich

[11] 4,106,228

[45] Aug. 15, 1978

[54] SUSPENSIBLE ORNAMENTAL DISPLAY

[76] Inventor: Jack Gibrich, 2953 Briarwood Dr. W., Arlington Heights, Ill. 60005

[21] Appl. No.: 788,802

[22] Filed: Apr. 19, 1977

[51] Int. Cl.[2] ..... G09F 7/00

[52] U.S. Cl. ..... 40/605; 40/613; 428/8; 428/18; D11/118; 40/617

[58] Field of Search ..... 40/138, 128, 126 A, 40/124, 124.1, 124.2, 124.4; 428/8, 9, 7, 18; D11/118, 121, 141, 142; 272/8 D; 46/30, 31

[56] References Cited

U.S. PATENT DOCUMENTS

| | | | |
|---|---|---|---|
| D. 163,476 | 5/1951 | Olson | D11/118 |
| D. 180,969 | 9/1957 | Swearingen | D11/118 |
| 2,076,956 | 4/1937 | Lowenstein | 46/31 X |
| 2,791,868 | 5/1957 | Viken | 46/30 |
| 2,988,837 | 6/1961 | Hutton | D11/118 X |
| 3,655,495 | 4/1972 | Carrell | 428/18 X |
| 3,921,312 | 11/1975 | Fuller | 46/30 X |

FOREIGN PATENT DOCUMENTS

| | | | |
|---|---|---|---|
| 1,368,151 | 9/1974 | United Kingdom | 46/30 |

*Primary Examiner*—John F. Pitrelli
*Attorney, Agent, or Firm*—Leydig, Voit, Osann, Mayer & Holt, Ltd.

[57] ABSTRACT

A substantially flat, suspensible, ornamental display comprised of a plurality of identical flat, rigid members arrayed in partially overlapping relationship in accordance with a regular pattern, with the overlapping portions of the members fastened together, is readily enlarged or reduced in size by the user, resists disruption caused by air currents, and is conveniently shipped and stored. The members are assembled to leave openings between adjacent members that are similar in shape to the members, and ornamental devices are detachably suspended in the openings.

6 Claims, 3 Drawing Figures

SUSPENSIBLE ORNAMENTAL DISPLAY

DESCRIPTION OF THE INVENTION

This invention relates generally to suspensible ornamental displays, and more particularly, to substantially flat, suspensible, ornamental displays. Such displays are commonly hung from the ceilings of public halls and the like for decorative or promotional purposes. For instance, suspensible displays are often used in shopping centers, department stores, and convention halls.

As compared to displays that are designed to be supported by a wall or on the floor, suspensible displays offer the advantages of versatility, extremely efficient use of space, and relatively great visibility. Displays that are supported by a wall are visible from only one side, and must be relatively large to assure visibility. A display that is supported by the floor must also be relatively large. Moreover, the availability of wall and floor space for special decorative and promotional purposes is typically limited by the regular and more valuable uses to which these areas can be devoted. Because a large amount of overhead space is typically available in public halls, and because this space provides a highly visible location for display purposes, suspended displays are extremely advantageous.

Notwithstanding the versatility which use of overhead space affords, certain problems are encountered in the use of suspensible displays. The size of the room and the amount of overhead space available vary from one location to another, so the optimum display size varies, depending on the available space and the individual desires of the user. This necessitates either custom manufacturing, with increased expense, or some compromise on the part of the user.

Another difficulty encountered in the use of suspensible displays is the tendency of air currents to disrupt the display. This problem is particularly acute in the case of substantially flat displays, where air currents may cause the display to partially rise or twist. The problem of disruption by air currents naturally increases with the size of the display. Further problems encountered with large displays include the difficulties and inconveniences involved in shipping them and in storing them between uses without incurring damage.

An object of the invention is to provide a substantially flat suspensible ornamental display that can readily be enlarged or reduced in size by the user, and that can nevertheless be manufactured in standardized form.

Another object of the invention is to provide such a display that, even in enlarged form, is sufficiently rigid to avoid disruption by air currents.

Yet another object of the invention is to provide such a display that can be shipped and stored in disassembled form, and can be readily assembled for use.

A further object of the invention is to provide such an ornamental display that can be efficiently and economically manufactured.

Other objects and advantages of the invention will be apparent from the following detailed description and the accompanying drawings, in which.

Although the invention will be described in connection with a certain preferred embodiment, it will be understood that it is not intended to limit the invention to that particular embodiment. On the contrary, it is intended to cover all alternatives, modifications, and equivalents that may be included within the spirit and scope of the invention.

Turning now to the drawings, the invention is there illustrated in a substantially flat ornamental display 1 that is suspended from a ceiling 2 on a plurality of wires 3. In this particular embodiment, the ornamental display has a Christmas theme. The display has a number of traditional Christmas figures 4 represented on both surfaces and has an overall shape resembling a Christmas tree.

Figure 2:
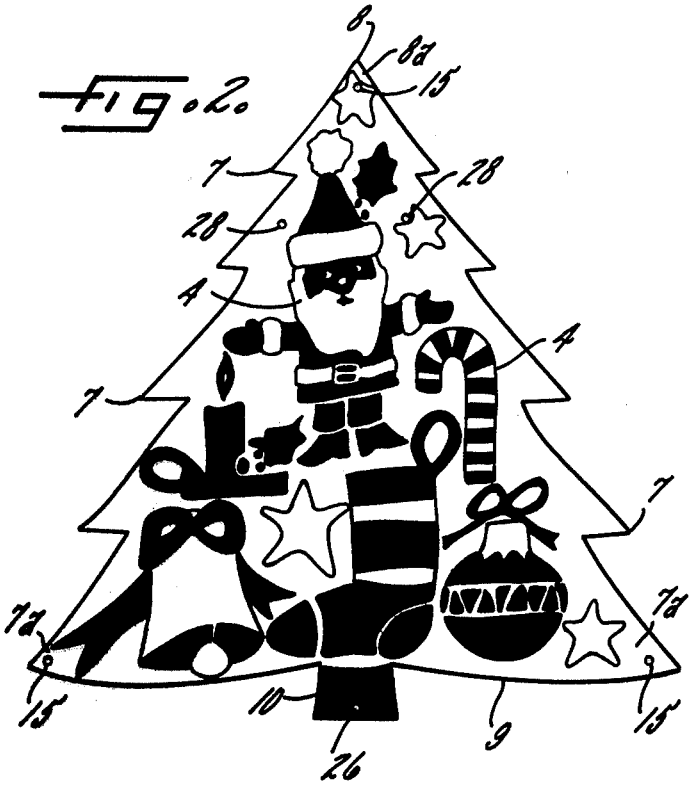
FIG. 2 is an enlarged side elevation of an individual member in the display of FIG. 1.

In accordance with the present invention, the display 1 comprises a plurality of substantially flat members 5 that are identical in size and shape and arrayed in a regular pattern to produce an assemblage in which adjacent members define openings 6 of similar shape to the members. Each member in the illustrated embodiment has an identical symmetrical Christmas tree-like shape. Thus, the representative member 5 that is shown in FIG. 2 has a generally triangular shape that is interrupted by a number of angular protrusions 7 along two of its sides to represent boughs of the trees; the point 8 where the two sides with angular protrusions meet represents the top of the tree; and a relatively smooth side 9 with a centrally located square protrusion 10 represents the bottom of the lower boughs and the trunk of the tree.

Figure 1:
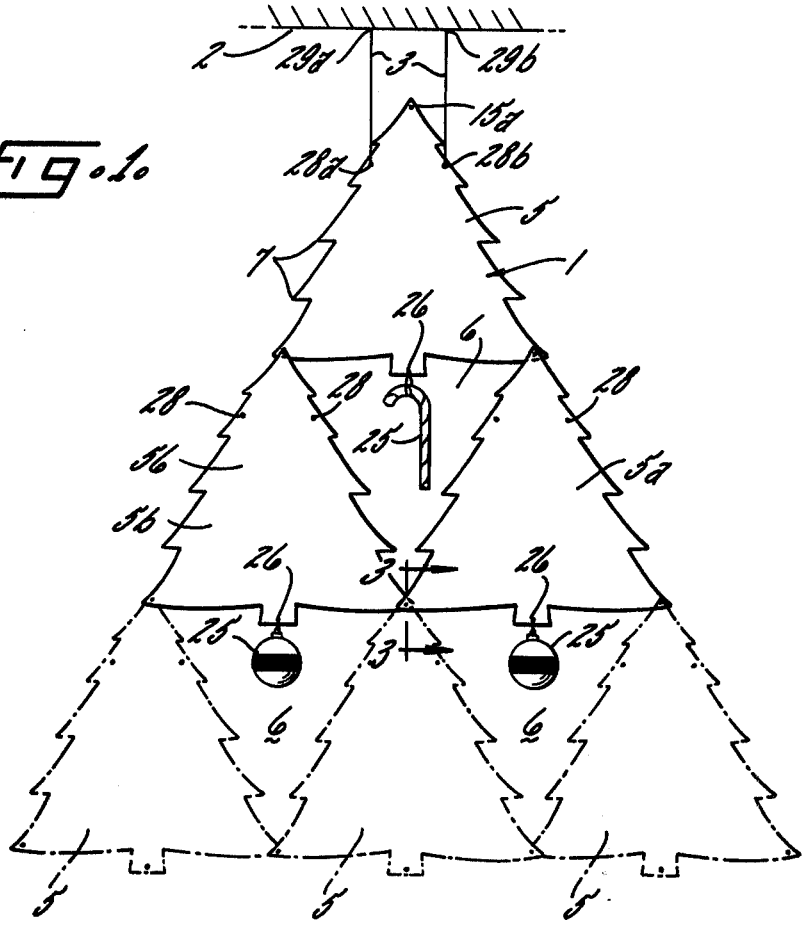
FIG. 1 is a side elevation of a suspended substantially flat display comprised of a plurality of assembled members in accordance with the present invention.

As shown in FIG. 1, the members are arrayed so that each member in the assemblage is similarly oriented and each member is in partially overlapping relationship with every adjacent member. More particularly, horizontally adjacent members are arrayed so that lower bough portions *7a* of any two horizontally adjacent members are mutually overlapping; and vertically adjacent members are arrayed so that, for each member that is located above an adjacent lower member, a lower bough portion *7a* of the higher member is partially overlapping with the tree-top portion *8a* of the lower member. In this manner, a plurality of members 5 like that shown in FIG. 2 are assembled in a pyramidal fashion wherein adjacent members define openings 6 which have a Christmas tree shape similar to that of the members.

To provide a substantially flat display that will not be subject to undesirable deformation or other disruption by air currents, the individual members are formed out of a rigid material. Any flat, rigid material may be used, but corrugated cardboard sheet material is preferred, because with it an adequate degree of rigidity can be obtained while maintaining a relatively low weight, and it is inexpensive and easy to work with as well. An important feature of the invention is that the rigidity which characterizes the individual members is maintained in the assemblage of members by the partially overlapping relationship in which the members are assembled.

To assist the user in assembling the members and fastening them together, each member is provided with a plurality of apertures 15. Each of the members has an identical array of apertures, and one aperture is located in each of the areas of the members *7a,8a* that may be brought into overlapping relationship with portions of other members in an assemblage. These apertures are positioned so that when the members are assembled in the correct pattern, the apertures in the overlapping portions of adjacent members will be aligned. Thus, the apertures are an aid in assuring that the members are correctly assembled, and minimize the necessity of corrective adjustment after the members are fastened together. The apertures have a further function in that they assist in the actual fastening of the members to each other.

Figure 3:
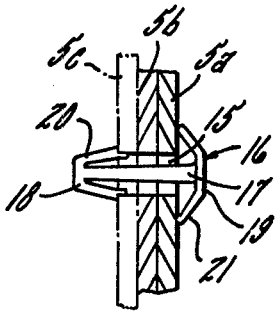
FIG. 3 is an enlarged partial side elevation along line 3—3 in FIG. 1 showing the relationship of adjacent members in the display and the means by which they are fastened together.

To fasten together the overlapping portions of adjacent members, it is preferred to use a fastener 16 of the type which will provide a shaft 17 passing through the aligned aperture 15 and have an enlarged head 18,19 on both sides of the shaft, between which the overlapping members *5a,5b,5c* are held firmly together, as illustrated in FIG. 3. The illustrated fastener 16 is constructed of plastic. It comprises a shaft 17 having, at one end, an element 18 with flexible barbs 20, and, at the other end, an enlarged element 19 that is incapable of passing through the apertures. The barbed end of the fastener can be inserted through the aligned apertures due to the fact that the flexible barbs 20 are deflected as the fastener is being inserted, the undeflected position of the barbs being such that the barbed end is larger than the aperture. When the fastener has been inserted to the point where the enlarged element is in contact with the member *5a* on its side of the aligned aperture, the flexible extensions 21 on the enlarged element 19 permit the fastener to be inserted a slight further distance by applying pressure to the enlarged element. When the fastener is inserted to its furthest extent, the barbs 20 clear the member *5c* on its end of the aligned apertures, and thus return to their undeflected positions. When pressure on the enlarged member is released the overlapping members are held firmly together between the enlarged element and the barbed element, and are prevented from relative transverse movement by the shaft of the fastener which passes through the aligned apertures. It will be understood that the particular fastener that is shown in the figures is illustrative only, and that fasteners of different design may also be used. For example, if it is desired to use a fastener that is more easily removed, it is possible to use common brass paper fasteners, or even small bolts with nuts.

The inverted Christmas tree-shaped openings 6 that are defined by adjacent members in the assembled display have several important functions. First, by virtue of their shape, the openings reinforce the ornamental theme of the display. They also reduce the effect that air currents have on the display, because they allow the currents to pass through the display and, at the same time, reduce the surface area resisting the currents. Further, the openings reduce the weight of the display, which makes the display easier to suspend.

In addition to the decorative function which the openings 6 serve by virtue of their shape, the openings also provide a space in which decorative ornamental devices 25 can be suspended. If desired, each of the members can be provided with apertures 26 to assist in suspending these devices.

To assist in hanging the assembled display, a plurality of additional apertures 28 in each member are provided for receiving and attaching the wires or other suspension means on which the display is to be suspended. It has been found desirable to suspend the display on a plurality of strings or wires 3 that extend from separated points *29a,29b* on the ceiling and are attached to the display at separated points *28a,28b,* as this reduces the tendency of the display to rotate. If a rigid suspension means that does not permit rotation is used, or if rotation is not considered a problem, the display can be suspended from a single point on the display. The aperture *15a* located at the top of highest member in the illustrated embodiment could be used for this purpose.

In accordance with a principal feature of the invention, the display can be enlarged to produce a display of similar shape by the simple expedient of including a greater number of members in the assemblage. As illustrated in FIG. 1, the lower tier of members 5, shown in broken lines, can be incorporated into the assemblage to produce a display that has a similar shape to the one that is produced without the lower tier. Additional tiers beyond the one shown in broken lines could obviously be added.

In the illustrative embodiment, the overall shape of the display is similar to the shape of the individual members, and this is a preferred feature. However, the shape of the assemblage may differ from the shape of the members without departing from the spirit of the invention. Similarly, it is not necessary for the members to have a generally triangular shape, and identical members that are generally diamond shaped, square shaped, or rectangular shaped, for instance, may be suitable for use in displays that are based on ornamental themes to which these general shapes are adaptable. In these cases, the pattern of arrangement, and thus the pattern of the appertures, must be adapted to the general shape of the member.

Because the members have a general geometric shape that permits maximum use of material, the display embodying the present invention is economical to manufacture. Because the display can be shipped and stored in disassembled form, the difficulties and inconveniences that are typically incurred in connection with shipping and storing relatively large, rigid displays are avoided. Because each member is identical in size and shape, and each is provided with an identical array of apertures for the various purposes hereinbefore discussed, the members are completely interchangeable, and are readily assembled.

I claim as my invention:

1. A suspensible ornamental display comprising:

a plurality of rigid, substantially flat members, each of said members having the same shape and being of the same size, said members being arrayed in accordance with a regular pattern to form an assemblage wherein adjacent members are in partially overlapping relationship and openings are defined by said adjacent members, said openings having a shape substantially similar to said members, said assemblage being capable of enlargement to an assemblage of similar shape by increasing the number of members arrayed in said assemblage, said assemblage has a shape substantially similar to the shape of said members, said members are generally triangular in shape, and said similarly shaped openings are inverted; means for fastening together the overlapping portions of the members in said assemblage to form a rigid display that can be suspended; an ornamental device is suspended in at least one of said openings, said ornamental device being suspended from one of the members which define said opening; and means for suspending said ornamental display attached to the periphery of one of said members.

2. The suspensible ornamental display of claim 1 in which the shape of said members resembles a Christmas tree.

3. The suspensible ornamental display of claim 2 in which said members are made of cardboard.

4. The suspensible ornamental display of claim 3 in which said members are decoratively printed on both sides.

5. The suspensible ornamental display of claim 1 in which each of said members has apertures located in the portions of said members that are in overlapping relationship with adjacent members, said members being identical in respect to the number and position of said apertures, the regular pattern in which said members are arrayed bringing the apertures of overlapping portions of adjacent members into alignment; and said fastening means passes through said aligned apertures to fasten said members together.

6. The suspensible ornamental display of claim 5 in which said fastening means comprises a shaft for passing from one end of said aligned apertures to the other;

an enlarged element at a first end of said shaft, said enlarged element being of sufficient size to be incapable of passing through said apertures;

a barbed element at the second end of said shaft, said element having barb means that extend outwardly from the second end of said shaft and toward the first end of said shaft, said barb means being flexibly deflectable towards the shaft to allow insertion of the barbed end of said shaft through said aligned apertures, said barb means returning to an undeflected position when clear of said apertures so that said barbed element is of greater size than said apertures when said barb means are undeflected, said barb means resisting reverse passage of the shaft through said apertures once the barbed element has passed completely through said apertures.

* * * * *